United States Patent [19]

McCreary et al.

[11] 4,265,982

[45] May 5, 1981

[54] COATED WOVEN MATERIALS AND METHOD OF PREPARATION

[75] Inventors: William J. McCreary; David W. Carroll, both of Los Alamos, N. Mex.

[73] Assignee: The United States of America as represented by the United States Department of Energy, Washington, D.C.

[21] Appl. No.: 47,445

[22] Filed: Jun. 11, 1979

[51] Int. Cl.[3] ..... B05D 1/22; B32B 7/08

[52] U.S. Cl. ..... 428/608; 427/243; 427/244; 427/245; 427/247; 428/263

[58] Field of Search ..... 427/213, 243, 244, 245, 427/247, 249, 251; 428/263, 608

[56] References Cited

U.S. PATENT DOCUMENTS

| | | | |
|---|---|---|---|
| 3,178,308 | 4/1965 | Oxley et al. | 427/213 |
| 3,202,537 | 8/1965 | Norman et al. | 427/213 X |
| 3,264,073 | 8/1966 | Schmitt | 29/182 |
| 3,343,979 | 9/1967 | Hamrin | 427/213 X |
| 3,594,215 | 7/1971 | Wakefield | 427/213 X |
| 3,796,589 | 3/1974 | Ciramella et al. | 427/213 X |
| 4,071,304 | 1/1978 | Chauvin et al. | 427/213 X |
| 4,080,927 | 3/1978 | Brown | 427/213 X |
| 4,169,911 | 10/1979 | Yoshida et al. | 428/288 X |
| 4,180,428 | 12/1979 | Rile et al. | 427/249 X |

OTHER PUBLICATIONS

Powell et al., "The Formation of Metallic Coatings by Vapor Phase Techniques", *Metal Finishing,* vol. 50, No. 4, Apr. 1952, pp. 64–69.

*Primary Examiner*—James R. Hoffman

*Attorney, Agent, or Firm*—Elizabeth O. Slade; Paul D. Gaetjens; Richard G. Besha

[57] ABSTRACT

Coating of woven materials so that not only the outer surfaces are coated has been a problem. Now, a solution to that problem is the following: Woven materials are coated with materials, for example with metals or with pyrolytic carbon, which materials are deposited in Chemical Vapor Deposition (CVD) reactions using a fluidized bed so that the porosity of the woven material is retained and so that the tiny filaments which make up the strands which are woven (including inner as well as outer filaments) are substantially uniformly coated.

22 Claims, 11 Drawing Figures

SEM
80 x
UNCOATED

SEM
45 x

SEM
80 x
INVENTION

SEM
400 x
UNCOATED

SEM
1300 x

SEM
400 x
INVENTION

CROSS-SECTION
250 x

CROSS-SECTION
250 x
INVENTION

CROSS-SECTION
500 x
INVENTION

COATED WOVEN MATERIALS AND METHOD OF PREPARATION

BACKGROUND OF THE INVENTION

1. Field of the Invention

This invention relates to a method of coating woven materials with various materials and to articles of manufacture prepared by the method of this invention. It is a result of a contract with the Department of Energy (Contract No. W-7405-Eng-36).

2. Description of the Prior Art

An important problem is how to coat a woven material uniformly, for example with a metal or with pyrolytic carbon, so that the coated woven material retains the structural properties of a woven material (i.e., for example, its flexibility and porosity), while at the same time the woven material is altered to withstand more severe environments than the bare woven material would ordinarily tolerate and to assume physical properties (e.g., increased density and strength) not possessed by the parent uncoated woven material. Such a strengthened, flexible, porous coated material would find a wide variety of applications, for example, in the automobile industry, in the aircraft industry, or wherever strong, yet relatively light-weight porous materials are important.

It is known in the prior art to employ chemical vapor deposition within a fluidized bed for coating particles on the order of 100 to 1000 microns ($\mu$) in size and for coating rigid, fragile extended bodies such as those disclosed in Nack, U.S. Pat. No. 3,382,093. However, in the prior art, woven materials have not been coated in fluidized beds and, furthermore, not so that each tiny filament making up a larger woven strand is individually coated and so that the porosity is retained. One would probably not expect a fluidized bed to be very useful in coating a woven material because one would probably expect that a coating material such as a metal or pyrolytic carbon would coat the woven fabric in a distorted fashion, that the coated fabric would crack as it flexes in the bed, and that eventually the coated material would take on a preferred, distorted shape in the bed. Furthermore, rather than expecting individual filaments (including even the inner filaments) which make up the woven strands of the fabric to be individually coated, one would probably expect bridging (i.e., coating of the outside yarn) to occur.

Until now, methods which have been used in the prior art to impregnate open-pore structures with deposited materials have generally included holding the structure to be impregnated in a stationary position at a uniform or somewhat graded temperature and passing the reacting gases over that structure. In a particular prior art method, reacting gases were allowed to passively diffuse into the substrate held in a stationary position.

However, such prior art methods have had their drawbacks. Generally they required low gas flow rates in order to try to achieve uniform deposition, and generally they were subject to the problem of gas phase nucleation (in which the reacting gases react above the substrate, forming molecules of the plating material which agglomerate and eventually fall onto the substrate). Thus, gas phase nucleation resulted in the formation of nodules on the substrate surface.

Now a new method for coating woven materials has been discovered. This method reduces the problem of gas phase nucleation for a given set of conditions. For example, for a given type of metal-containing gas, a given flow rate thereof, a given reaction temperature, and a given substrate, gas phase nucleation is reduced by using the method of this invention, as compared with using the prior art methods described above.

The method according to the invention can be very advantageously used to produce strong but porous articles of manufacture which are suitable for a wide variety of uses. Furthermore, a multiplicity of segments of woven materials can be metal-coated simultaneously and uniformly; and this capability is very important. Further, the method of the present invention can be used to coat woven materials made up of very short fibers, which fibers could not first be coated with metal and then woven. And when a catalytic support is prepared by the method of the present invention, a relatively very small amount of metal can have a very large surface area.

In particular, when the method of this invention was used to coat a woven graphite cloth with tungsten metal by reacting hydrogen gas ($H_2$) with tungsten hexafluoride gas ($WF_6$) as described in Example II below, the individual filaments forming the woven strands of that woven cloth were substantially uniformly coated throughout the cloth; and, although tungsten is a relatively brittle metal, the coated woven material retained its flexibility even when the amount of coated tungsten comprised about 90 or 95% of the total weight of the tungsten-coated woven material.

STATEMENT OF THE OBJECTS

It was an object of this invention to provide a method of uniformly coating woven materials.

A further object of this invention was articles of manufacture prepared from uniformly coated woven materials.

Other objects, advantages and novel features of the invention will be apparent to those of ordinary skill in the art upon examination of the following detailed description of a preferred embodiment of the invention and the accompanying drawings.

SUMMARY OF THE INVENTION

According to the invention, a woven material is coated with a material to be deposited (i.e., deposition material) such that the inner as well as outer filaments making up the strands which form the woven material are individually and substantially uniformly coated and such that the porosity of the woven material is substantially retained, the coating method comprising coating the woven material by allowing a chemical vapor deposition (CVD) reaction to take place at the surfaces of the woven material while the woven material is located within a fluidized bed. Thus, the following steps will generally be carried out in the following order:

(1) passing a first gas through a bed of carrier particles located in a chamber so as to produce a fluidized bed;

(2) introducing the woven material into the fluidized bed and heating the chamber and its contents to a chosen deposition temperature; and (3) passing through the fluidized bed at least one reactant gas containing the material to be deposited mixed together with any other gas necessary for the chosen deposition reaction to take place and allowing the deposition material to be deposited onto the woven material.

Further, according to the invention, an article prepared according to the inventive method can be used as a catalytic support for a catalytic converter or as a filter.

BRIEF DESCRIPTION OF THE DRAWINGS

FIG. 3 at a magnification of 80X shows uncoated cloth; FIG. 4 at a magnification of 45X shows cloth coated with tungsten by the prior art method described below in Example 1; and FIG. 5 at a magnification of 80X shows cloth coated with tungsten by the inventive method under the particular conditions described in Example 2.

DESCRIPTION OF THE PREFERRED EMBODIMENTS

Figure 1:
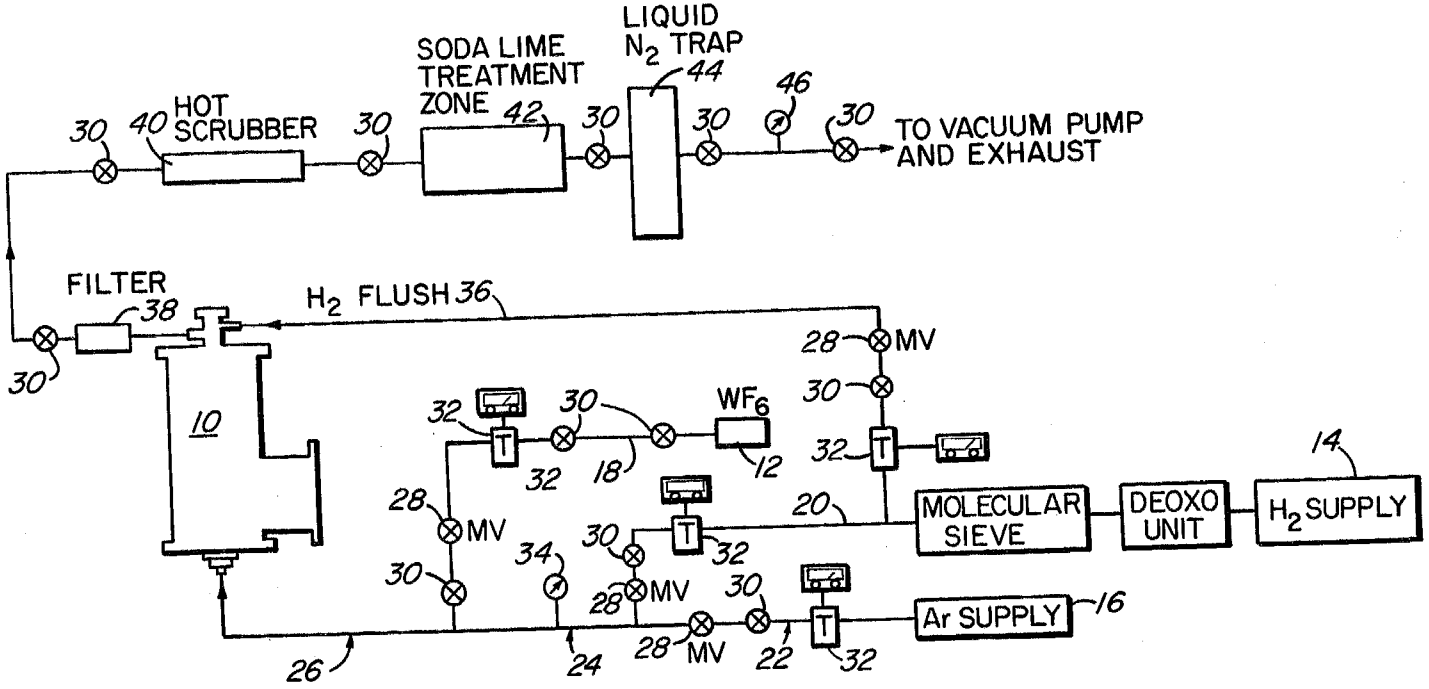
FIG. 1 is a diagrammatic illustration of the coating system which was designed for and used in coating a woven material with tungsten which formed when tungsten hexafluoride reacted with hydrogen gas, as described below in Example 2.

The term "chemical vapor deposition (CVD) reaction" is used herein to mean a reaction which involves the transport of vapor of a compound which usually contains a metal to a usually hot substrate, followed by the thermal or chemical reduction of an ion (usually a metal ion) in the vapor species at or near the substrate, followed by the nucleation and deposition of the reduced species onto the substrate.

When the coating conditions are suitably adjusted so that the motion of the woven material in the fluidized bed is substantially random and so that the deposition temperature and gas flow rates are suitably chosen, the individual tiny filaments forming the woven strands are individually and substantially uniformly coated.

In the practice of the invention, in order to achieve a substantially uniform deposition of coating material on each individual filament making up the woven strands of woven material, it is a requirement that over a time-average, the individual fibers (i.e., filaments) of the woven material experience substantially identical coating conditions. To this end, very thorough mixing of the bed and substantially random movement of the woven material in the bed result in a uniform temperature distribution and a uniform gas distribution throughout the bed. Mass (or density) of the fluidized bed must be adequate to support the segments of fabric, and the dimensions of the bed must be adequate for substantially random motion of the fabric to occur throughout the bed.

Although the following is written particularly in terms of depositing a metal onto a woven material by a chemical reduction reaction of a metal hexafluoride with hydrogen gas, it is expected that a wide variety of other materials, especially other metal halides, can be used to form uniform deposits on woven materials by allowing the appropriate chemical vapor deposition reaction to proceed under appropriate conditions in a fluidized bed. For example, pyrolytic carbon can be substantially uniformly deposited onto a woven material by decomposing a suitable hydrocarbon (for example, methane) onto woven materials which are in substantially random motion in a fluidized bed, provided that the carbon is deposited at a suitable rate. Likewise, carbonyl compounds, for example, nickel carbonyl, molybdenum carbonyl, iron carbonyl or mixtures thereof are expected to give good results.

Generally, when two gases react in a CVD process, a suitable deposition rate will be selected in the following manner. The appropriate chemical equation which describes the formation of the desired deposition product is first established, for example, by consulting the literature. Likewise, the lowest reaction temperature is thus found. Fluidization of the bed in which the woven material is located is established, for example, using an inert gas or gases at the lowest reaction temperature. Thereafter, the lighter of the two reactant gases can be substituted for the inert gas or gases, either in part or in total. The molar ratio of reactant gases is found from the chemical equation and is then adjusted to provide an excess of one reactant gas, generally the lighter gas. This adjustment can generally be made by increasing by a factor of 10 the flow rate of the reactant gas which does not contain the material to be deposited, while the flow rate of the other reactant gas is held constant. A trial run is then made using the determined flow rates at the reaction temperature, and the quality of the deposited material is noted. If no nodules have formed, the reaction rates are suitable. If nodules have formed, the molar ratio is further adjusted by reducing by a factor of 2 the flow rate of the gas containing the material to be deposited. It is believed that when two such trial runs are made in the above-described manner, one will establish a suitable (although not necessarily an optimum) set of conditions for achieving uniform deposition of plating material with a 2-gas CVD reaction in a fluidized bed.

Similarly, when the CVD reaction is a pyrolysis reaction using a sole reactant gas, for example, a metal carbonyl or a hydrocarbon, an inert gas (or gases) is first used to establish the fluidized bed. Then, the reactant gas can be introduced into the reactor at a flow rate which is one-thirtieth the established flow rate of the inert gas (or gases). A trial run is made; and if nodules have not formed, the flow rates are suitable. If nodules have formed, the flow rate of reactant gas is reduced by a factor of two.

Table I which follows can be used conveniently to select conditions suitable for obtaining substantially uniform coating of woven materials in a fluidized bed, using the particular reactant plating gases shown in the table.

Referring to the drawing, in FIG. 1, in one embodiment, a coating chamber referred to generally as 10 (and shown in more detail in FIG. 2) is located downstream from a source of tungsten hexafluoride gas 12, a source of hydrogen gas 14, and a source of argon gas 16. These sources flow respectively through conduits 18, 20, and 22, conduits 20 and 22 combining to form conduit 24, which combines with conduit 18 to form conduit 26. Metering valves 28, ball valves 30, and transducers 32 are located in each of conduits 18, 20 and 22. Transducers 32 measure the mass of gas flowing through each conduit by measuring the amount of cooling which occurs inside a thermocouple located within each transducer 32. A pressure gauge 34 is located within conduit 24, as shown.

A hydrogen flush 36 (shown in more detail in FIG. 2 as described below) is fed by hydrogen supply 14, as shown in FIG. 1.

Located downstream from coating chamber 10 are filter 38, hot scrubber 40, soda lime treatment zone 42, liquid nitrogen trap 44, pressure gauge 46, vacuum pump (not shown), and the exhaust (not shown). These items are connected in series by conduits, are separated by ball valves, as shown in FIG. 1, and are used to treat exhaust gases which are withdrawn from the coating chamber 10. The exhaust gases in Example 2 are hydrofluoric acid and excess hydrogen.

vertical and any straight line located within the surface of the cone which passes through the tip of the cone.

Outside and above the heated portion of reactor 50, located within the uppermost portion of stainless steel can 52, cooling water inlet 62 and outlet 64 are located. This cooling water is used to cool that uppermost portion, window 70, and the O-rings 65. Other water cooling (not shown) cools the remainder of the stainless steel can 52, all compartments of which are demountable, and cools O-rings 67. Shutter 68 is used to prevent the gases from attacking the sight window 70, which can be made from Lexan or any other suitable material. Hydrogen flush 36 (also shown in FIG. 1) is used to keep window 70 clear, so that one can observe the fluidized bed (not shown), which is located at the bottom of reactor 50.

Reactor 50 can be of any size suitable for coating the woven material which is to be coated. The size will be chosen such that the woven articles to be coated can freely and randomly circulate in the chamber. Generally, for a cylindrical coating chamber, when the diameter of the chamber is at least about 1.5 times the largest dimension of the woven material to be coated, substantially random motion of the woven material being coated will occur. However, as the size of the coating chamber increases, the gas flow required to fluidize the bed must be correspondingly increased.

TABLE I

Conditions for Substantially Uniform Coating of Individual Fibers of Woven Materials

| Metal-Containing Gas or Other Plating Gas | Preferred Embodiment $WF_6$ | Other Suitable Embodiments | | | |
|---|---|---|---|---|---|
| | | $ReF_6$ | $MoF_6$ | Hydrocarbons which form Pyrolytic Carbon | Nickel Carbonyl |
| Coating Temperature | | | | | |
| Minimum | 150° C. | 200° C. | 150° C. | 1000° C. | 80° C. |
| Suitable range | 150–600° C. | 200–300° C. | 150–600° C. | 1200–1400° C. | 80–250° C. |
| Preferred | 400–425° C. | 290–325° C. | 400–425° C. | 1200–1400° C. | 100–200° C. |
| Pressure in Reaction Chamber | | | | | |
| Maximum | Ambient | 100 torr | Ambient | Ambient | 300 torr |
| Suitable range | 10–150 torr | 10–70 torr | 10–150 torr | Ambient | 10–250 torr |
| Preferred | 10–60 torr | 10–70 torr | 10–60 torr | Ambient | 100 torr |
| Ratio of Rates of Flow of $H_2$:Metal-Containing Gas | | | | | |
| Suitable range | 10:1 to 50:1 | 10:1 to 30:1 | 10:1 to 30:1 | 30:1 (carrier to reactant) | 30:1 (carrier to reactant) |
| Preferred range | 15:1 to 20:1 | 25:1 to 30:1 | 15:1 to 20:1 | 30:1 (carrier to reactant) | 30:1 (carrier to reactant) |

Figure 2:
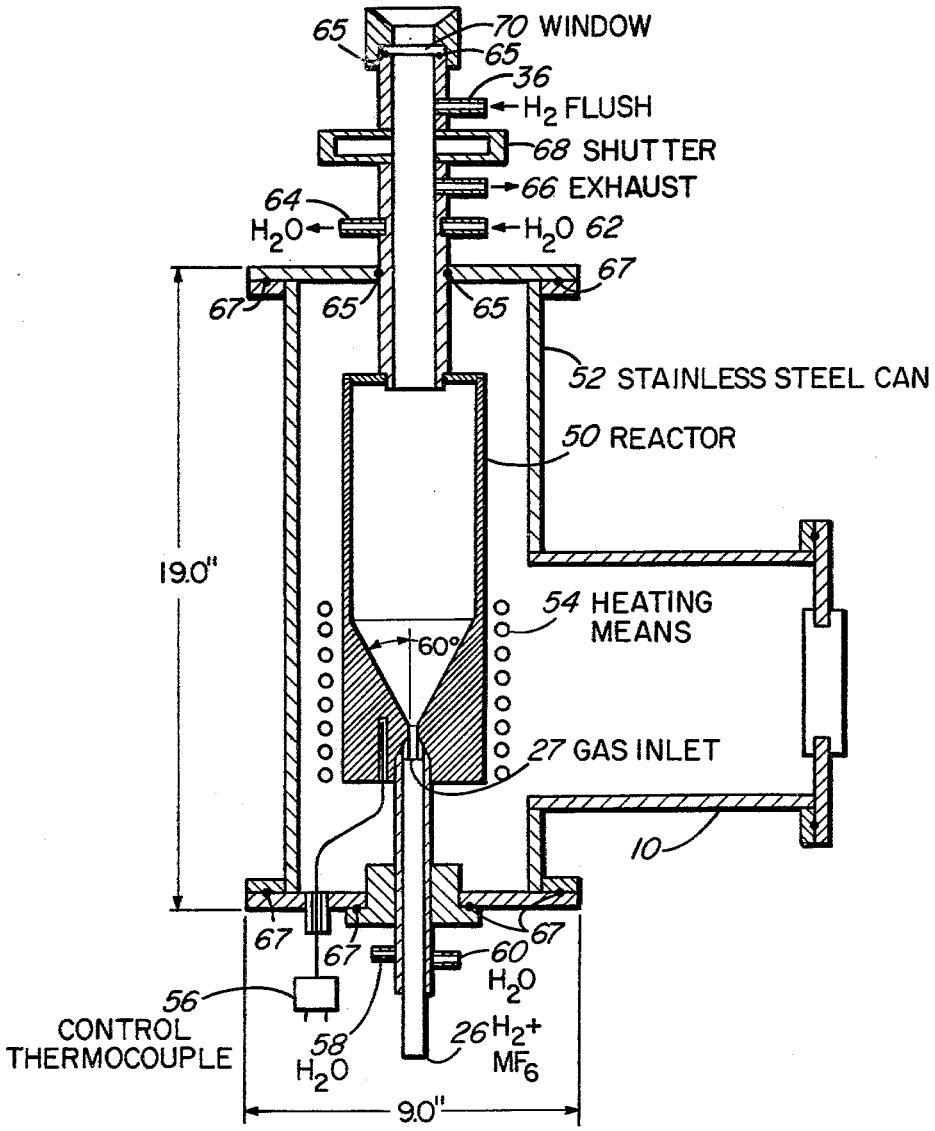
FIG. 2 is a diagrammatic illustration of the coating chamber 10, which was shown in FIG. 1.
Figure 3:
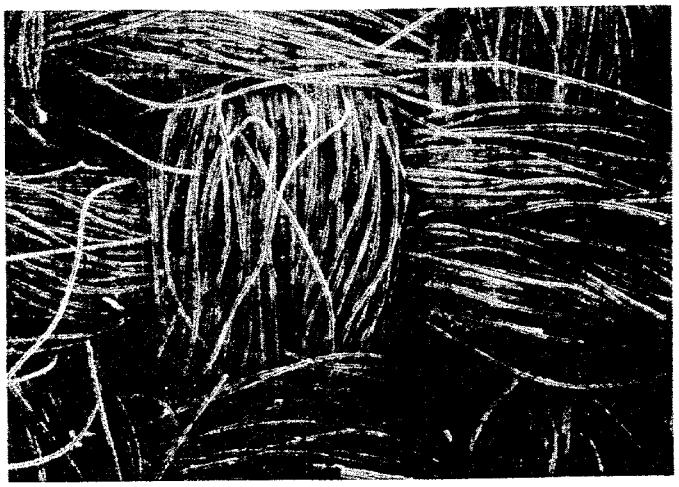
In FIGS. 3, 4 and 5, scanning electron micrographs (SEM's) show the woven strands of woven graphite cloth, as well as the individual tiny filaments or fibers which make up the strands.

In FIG. 2, coating chamber 10 comprises stainless steel can 52, reactor 50, and heating means 54. Stainless steel can 52 is used to provide a vacuum enclosure for the system and prevents gas from escaping through reactor 50. When reactor 50 is made from graphite (which is porous), this prevention is important. Heating means 54, which heats reactor 50, is controlled by control thermocouple 56. Conduit 26 (shown in FIGS. 1 and 2) serves as the inlet into reactor 50 for both of the reactant gases, hydrogen and tungsten hexafluoride. Cooling water flows around a one foot segment of conduit 26 located immediately adjacent to and below graphite reactor 50, the inlet for which is shown at 58 and the outlet for which is shown at 60. Graphite reactor 50 is in an upright position and has a bottom with the shape of a right cone. An angle of 60° is formed by the The sizes of the pieces of woven material to be coated can vary broadly. However, if quite large pieces (having diameters greater than about three inches) are to be coated, it may be necessary to provide supports (for example wires) around the perimeters of the pieces in order to prevent folding of the pieces during the coating operation.

The reactor 50 can be made up of any material compatible with the temperature employed in the reactor and with the gas or gases used to deposit the metal. A reactor made of graphite is especially preferred for use in coating cloth with a wide variety of coating materials because graphite is compatible with a wide variety of reactants and reaction products and can be used in a wide range of temperatures.

The design of reactor 50 is important since substantially random motion is a requirement of the invention. The gas inlet for the fluidizing gas should be situated beneath the area where the carrier particles making up the fluidized bed are located. The gas containing the material to be deposited can be introduced into reactor 50 ar any location which is below the level of the fluidized bed, this requirement minimizing the possibility of gas phase nucleation. If the two reactant gases are introduced through the same inlet, the gas inlet will be preferably cooled for example with water so that the reactants do not reach their reaction temperature before they enter the reaction chamber. If this cooling is not done, plugging of the gas inlet 27 may occur. As discussed above, the volume of the reactor 50 must be adequate for random motion of the fabric throughout the bed. The shape of the part of the reactor in which the fabric and carrier particles are free to move will preferably be conical so as to promote random motion of the bed.

The heating means 54 used to control the temperature in reactor 50 can be any heating means suitable for obtaining the desired temperature. However, an especially desirable means for heating the chamber is an RF induction coil. Such a coil produces a clean, safe way of heating the chamber; and by using such a coil, one can obtain a wide range of temperatures.

The fluidized bed in which the woven materials are coated can be prepared from a wide variety of types of material, sizes, and shapes. However, these variables should be adjusted so that the density of the bed lies within the proper range. If the bed is too dense, the woven material will ride on top of the bed; whereas if the bed is not dense enough, the pieces of woven material will fall to the bottom or to the sides of the coating chamber. Therefore, the density of the bed should be adjusted to promote random mixing of the fabric in the bed.

Although as stated above the shape of the carrier particles can be selected from a wide variety of shapes, generally the carrier particles will be substantially spherical. Such a shape provides good mixing of pieces of woven materials placed in the bed and does not damage the pieces.

The amount of carrier particles used to form the bed should be sufficient to enable the segments of the woven material to move substantially randomly in the bed.

The material from which the carrier particles are formed can be any material which is compatible with the coating conditions and which provides a bed having a suitable density. If desired, the carrier particles can be precoated with some of the material being deposited before the pieces of woven material are inserted into the bed.

Alternately, if desired, the carrier particles can be a mixture of various types, sizes, and shapes of materials.

The woven material which is to be coated can be selected from a wide variety of woven materials. However, the type of woven material should be selected so that its melting temperature is higher than the chosen temperature of deposition of the material which is to be deposited. The type of woven material to be coated should also be substantially inert to the reacting gases and to the reaction products. Also, the woven material should have an expansion coefficient which is not appreciably different from that of the metal being coated in order to avoid stresses on cooling. Any woven material satisfying these conditions can be coated by the method of this invention. Examples of suitable materials to be coated include graphite cloth, carbon cloth, ceramic cloth, and metal cloth. Provided that the reaction temperature is low enough, a wide variety of natural and man-made fabrics including but not limited to cotton, polyesters, polyolefins, and nylon can be used. The invention is not to be limited by these listed examples, however.

The strands making up the woven material can be woven quite tightly or quite loosely, as desired. Regardless of how tightly the strands of the material are woven, it is expected that when the amount of material deposited is sufficiently small, each filament making up each strand of the woven material will be individually and substantially uniformly coated. However, if a fabric is very tightly woven, the porosity of the coated material will be quickly reduced as the thickness of the coating deposit increases.

The woven material which is to be coated is not limited by the length of the filaments making up the woven material. Thus, even very short filaments can be coated by the method of this invention, whereas it would be impossible to first coat such very short filaments and then to weave them.

The thickness of the coating obtained by employing the method of this invention can be chosen as desired. The thickness will determine the amount of flexibility and the amount of porosity in the product coated material.

If metal is to be deposited onto the woven material any suitable gas or vapor metal plating procedure can be employed. For example, any suitable decomposition reaction, chemical reduction, pyrolysis, polymerization reaction, condensation and/or chemical reaction of a gas or gases, a vapor or vapors, or any mixture thereof which will deposit a metal onto the woven material can be employed in the practice of this embodiment of the invention. Particularly described in the examples which follow are chemical vapor deposition (CVD) reactions in which tungsten metal is deposited when tungsten hexafluoride gas and hydrogen gas react on the fabric surface. However, it is expected that other hexafluorides, including for example molybdenum hexafluoride and rhenium hexafluoride, and other metal halides will give good results.

In the process of the invention, a first gas in introduced into reactor 50 in such a way that it fluidizes the bed of carrier particles (i.e., the carrier particles are activated by the fluidizing gas which flows into the bottom of the reactor through an orifice and passes into the carrier material, thereby causing the carrier particles to circulate randomly throughout all the regions of the bed and thereby to resemble a boiling liquid.) A rate suitable for fluidizing the bed is determined empirically by adjusting the flow rate until the action of the bed resembles a boiling liquid. This first gas which is used to fluidize the carrier particles can be either an inert gas or a mixture of inert gases or a reactant gas or any combination of inert gas or gases and reactant gas. If a reactant gas is used to fluidize the bed, it should be readily available and inexpensive since a relatively large volume of gas will be used to fluidize the bed and to maintain the fluidized bed. When tungsten is to be deposited, hydrogen gas can be used both as a reactant and as a fluidizing gas, either alone or with an inert gas, for example argon or helium.

The flow rate of the gas or gases used to fluidize the bed should be selected so as to fluidize the bed to the desired extent, to maintain the fluidized bed, and if the fluidizing gas is a reactant to react to deposit the metal at a suitable deposition rate (which is selected as described above). Therefore, the flow rate will be varied, depending upon the density of the fluidized bed, the volume of the bed, and the volume of the reactor 50.

If a metal is the material to be plated, the plating of the woven material is generally accomplished by a chemical vapor deposition reaction. After the fluidized bed is established by the introduction of the first gas or gas mixture, a gas or vapor compound or compounds containing the metal to be deposited is next introduced into the coating chamber, mixed together with the reactant gas which reduces the metal. Provided that all of the reactants necessary to produce the metal to be plated are then present in the coating chamber and provided that the temperature in the reaction chamber is sufficiently high, the metal-forming reaction then takes place within the bed at the surfaces of the solid materials in the bed; and the metal is deposited onto the woven material, as well as onto the carrier materials. If desired, more than one metal can be deposited by introducing a mixture of metal-containing gases in this step.

In a metal-forming reaction, the chosen deposition temperature and the flow rate of the metal-containing gas or vapor will determine the coating rate of the woven material.

As the temperature in the coating chamber is increased, the rate of deposition of the metal increases. At excessively high deposition rates, stresses in deposited metal can occur, the pores of the woven material can clog, and nodules can form. Hence, to achieve a uniform deposition of metal on a woven material, the deposition temperature should not be excessively high.

The deposition temperature useful in a metal-forming CVD reaction is any temperature which satisfies the following two conditions. The temperature must be at least high enough for the metal-forming reaction to take place at the surfaces of the woven material, and the temperature must be low enough so that the metal-forming reaction proceeds at a sufficiently slow rate so that the pores of the woven material are not clogged. Thus, to determine an appropriate chosen deposition temperature, one determines first the lowest possible temperature for the particular reaction to proceed; and this temperature can, if desired, be used. To determine a suitable higher temperature for increasing the reaction rate (for a particular molar ratio of reactant gases) one can then raise the reaction temperature, provided that one does not exceed the temperature above which the pores of the fabric become plugged and/or the temperature above which nodules form.

The heating of the coating chamber should be kept substantially uniform throughout the coating reaction so as to aid in achieving uniform coating of the filaments making up the strands of the woven material.

When the reaction which deposits the metal is $3H_2+WF_6 \rightarrow 6HF+W$, the volume ratio of $H_2$:$WF_6$ which gives a satisfactory deposition of tungsten is a ratio within the range from about 10:1 to about 50:1; and that ratio preferably lies within the range from about 15:1 to about 20:1.

Generally, a vacuum pump will be used to withdraw waste gases from the reaction chamber.

Generally, the pressure in the coating chamber is not critical to achieving a uniform deposition of coating material. However, the pressure in the chamber will often lie in the range from about 50 torr to about 760 torr (standard atmospheric pressure). More often, the pressure will be chosen to lie within the range from about 10 to about 150 torr. However, the preferred range is from about 10 to about 60 torr.

As the coating reaction proceeds, the fluidized bed gets denser. Hence, it may be desirable to increase the flow of fluidizing gas at various time intervals during the coating reaction.

The metal-depositing reaction of tungsten hexafluoride with hydrogen gas occurs over a wide temperature range (i.e., from about 150° C. to about 1000° C.), and any temperature within this range is expected to provide a satisfactory plating of tungsten. Generally, the coating temperature for this reaction will be within the range from about 150° to about 600° C. However, the temperature range from about 400° to about 425° C. is the preferred temperature range because temperatures within this range provide a good reaction rate, do not require a large amount of cooling, and form uniform metal deposits.

After the desired amount of coating material has been deposited onto the woven material, the reaction chamber can be cooled and its contents can be removed. If desired, if metal was the material which was deposited, it can be removed from the carrier particles onto which it was also deposited and can be recycled by any suitable recycling operation.

The metal-coated woven material prepared by the method of this invention can be subjected to any further procedures, as desired.

For example, a useful further procedure is to hot-press multiple layers of metal-coated woven material so as to form three-dimensional articles.

EXAMPLES

The following examples were carried out, Example 1 (control) illustrating a prior art method of coating a woven material and Example 2 illustrating the method of the invention employing a fluidized bed. In both of these examples, the material to be coated was the same material (i.e., graphite cloth) and the metal plating was accomplished by using the chemical vapor deposition reaction of $3H_2+WF_6 \rightarrow W+6HF$. The flow rate of tungsten hexafluoride in Example 1 was one-half of that in Example 2, and thus this difference in flow rates would tend to produce a more uniform coating in Example I (control) than in Example II. The temperatures of the reaction in Examples 1 and 2 were substantially the same, and the pressure in the coating chamber for each example was approximately 100 torr. The gas inlet and gas exhaust were the same in Examples 1 and 2. In Example 1, no fluidized bed was used, whereas a fluidized bed was used in Example 2. Thus, the only important variables which differed in Examples 1 and 2 were the presence or absence of the fluidized bed and the flow rates of tungsten hexafluoride.

EXAMPLE 1 (CONTROL)

Figure 4:
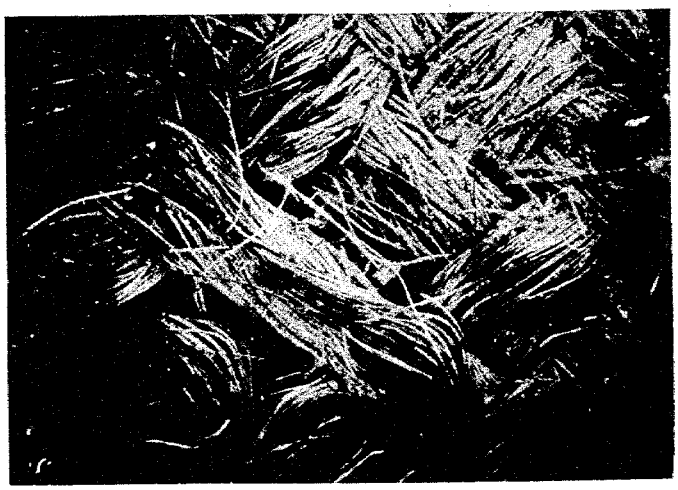
PRIOR ART Fig. 4
Figure 5:
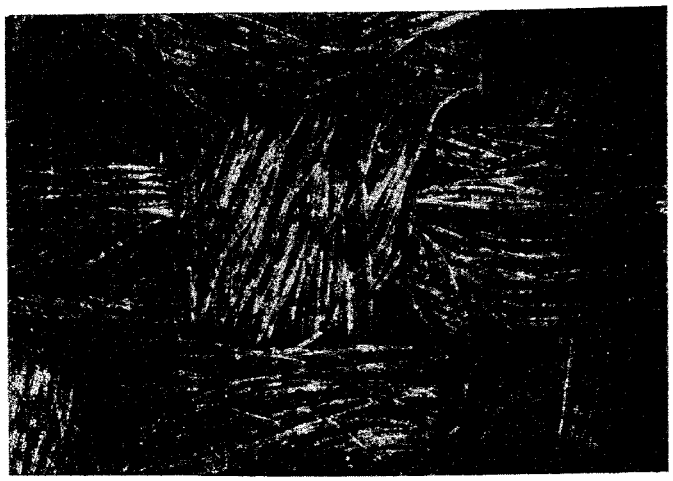
Figure 6:
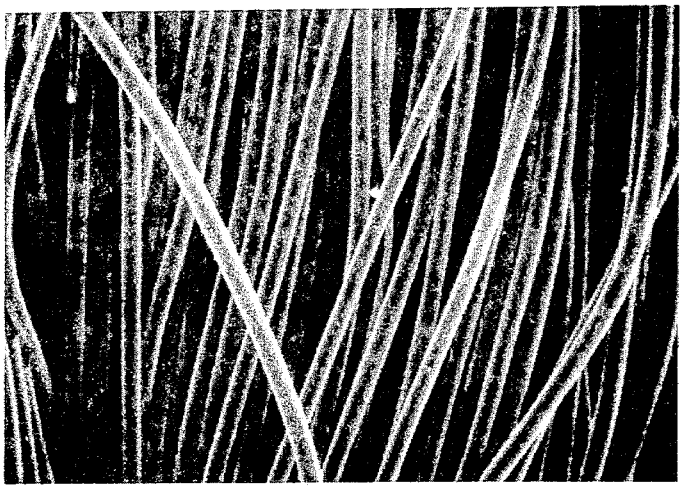
FIG. 6 is an SEM at a magnification of 400X showing individual filaments of an uncoated graphite cloth.
Figure 7:
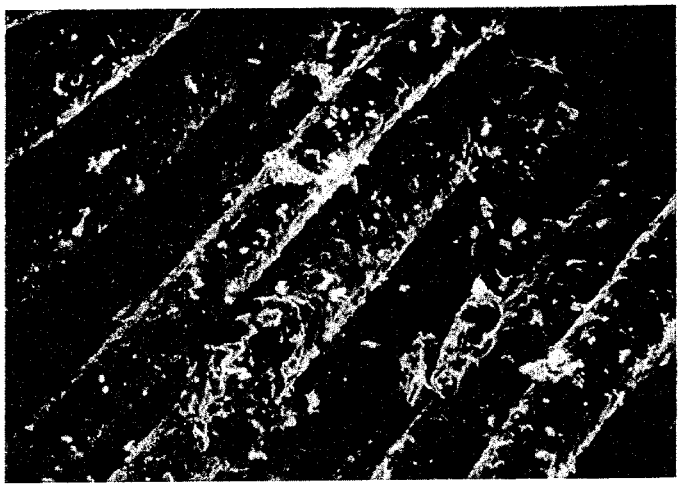
PRIOR ART Fig. 7
FIG. 7 is an SEM at 1300X showing filaments of tungsten-coated graphite cloth coated by a prior art method, the particular conditions of which are described in Example 1 below.
Figure 8:
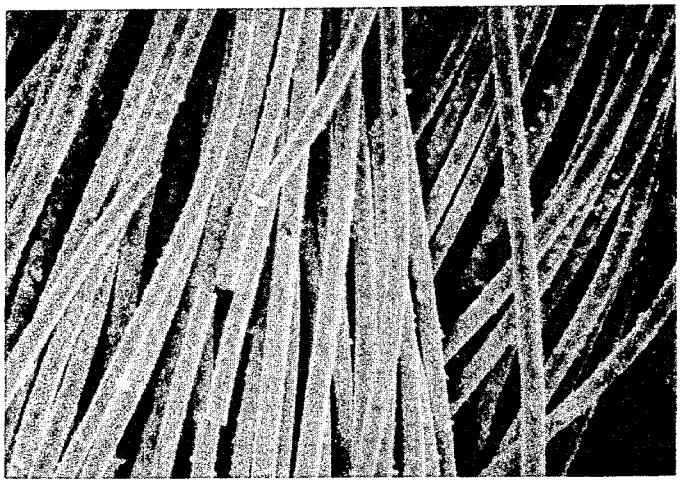
FIG. 8 is an SEM at 400X showing individual filaments of tungsten-coated graphite cloth coated by the method of this invention, under the particular conditions described below in Example 2.
Figure 9:
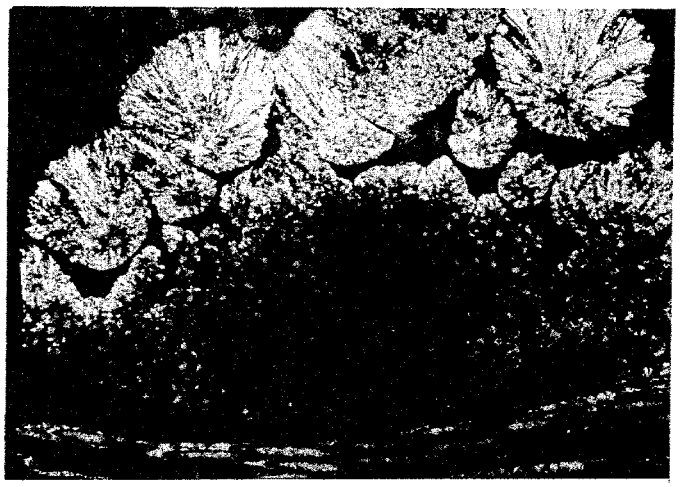
PRIOR ART Fig. 9
FIGS. 9 and 10 are SEM's at magnifications of 250X of cross sections of tungsten-coated graphite cloth, FIG. 9 showing that coated by the prior art method described in Example I and FIG. 10 showing that coated by the invention method described in Example 2, the white area around each filament being the tungsten coating.
Figure 10:
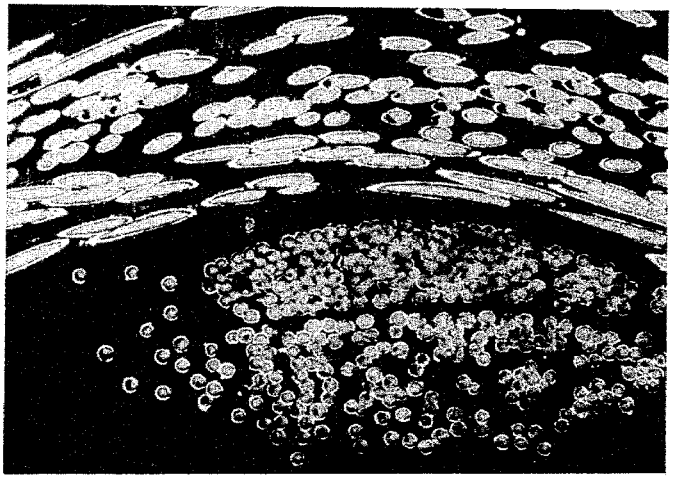
Figure 11:
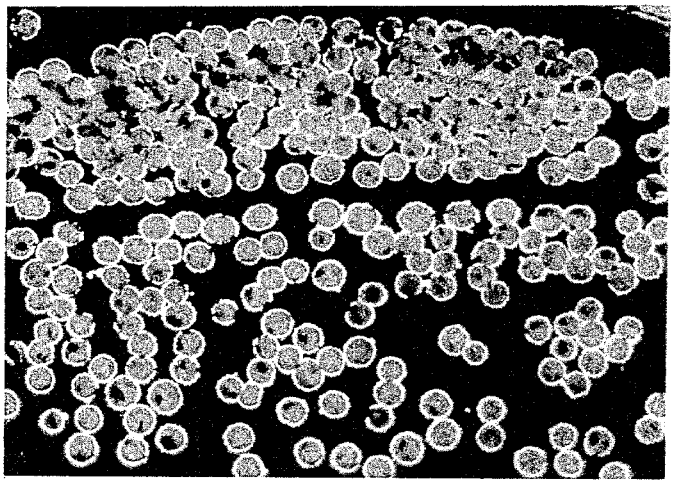
FIG. 11 is a cross section at a magnification of 500X showing a portion of FIG. 10.

This example employed a prior art, conventional chemical vapor deposition (CVD) reaction, wherein the gas mixture of tungsten hexafluoride and hydrogen was passed over a heated *stationary* substrate located in a cylindrical graphite chamber having a diameter of 40 mm and a volume of 100 cc. Ten discs of graphite cloth, each approximately 25.0 mm in diameter and each weighing approximately 0.12 g, were fastened onto five wires, the planes of the discs lying vertically with two discs on each wire. The discs were separated both horizontally and vertically so that no discs were in contact with each other. The discs were suspended in a stream of $WF_6$ and $H_2$ and were heated to 400° C. The flow rate (throughout the period of plating) of $WF_6$ was 10 cc/min. and that of $H_2$ was 500 cc/min., corresponding to a lower ratio of $H_2$:metal-containing gas than the initial ratio of $H_2$:metal-containing gas in Example 2 (invention) described below. The coating time was one hour, and the coating temperature was 400° C. FIG. 4 at a magnification of 45X, FIG. 7 at a magnification of 1300X and FIG. 9 at a magnification of 250X show SEM's of the graphite cloth which was coated by this prior art method, under the conditions described above. It can easily be seen especially from FIG. 7 that the coating was not uniform and that the tungsten metal tended to deposit in rough, uneven nodular structures. Furthermore, as shown in FIG. 9, not all the fibers were coated, the gas mixture having flowed preferentially along the outside of the graphite discs, instead of thoroughly penetrating the woven fiber structure. At the top of FIG. 9, one can see very large deposits which formed on the outer fibers. Furthermore, perturbations in the woven structure and holes punched in the cloth (not shown) resulted from the clamping technique which was needed to suspend the graphite cloth in the gas stream.

A variety of other geometric arrangements for holding the stationary discs were tried. However, none of these arrangements gave good results.

EXAMPLE 2 (invention)

A fluidized bed was prepared, using approximately 10 $cm^3$(cc) of spherical carrier material, which was hollow metal spheroids and which was precoated with CVD tungsten to increase its density to approximately 0.5 to 0.8 g/cc. The hollow metal spheroids used were Solacels®, which are manufactured by Solar Corporation and which are made from a nickel-manganese alloy. These lightly tungsten-coated spheres could pass through a sieve having 177 divisions per inch but could not pass through a sieve having 250 divisions per inch. This carrier material was deposited into an upright cylindrical graphite coater reactor having a diameter of 2.0 inches and a total volume of 64 cubic inches. The reactor which was used is shown schematically in FIG. 2. The shape of the bottom of the reactor is a right cone, a straight line located within the surface of the cone forming an angle of 60° with the vertical. Through gas inlet 27, hydrogen gas alone was first introduced into reactor 50 at a rate of about 500 $cm^3$/min. and was passed through the carrier material, causing it to fluidize. After fluidization was established, 5 woven graphite discs, each with a thickness of about 0.010 inch, macroscopic surface area of about 1.57 square inches, diameter of about 1.0 inch, strand density of 48 strands per inch, and an average strand thickness before coating of 320 μm, were introduced into the reactor. The graphite cloth from which the discs were cut is manufactured by Stackpole Company and is called PWC-3 graphite cloth. Then the entire system in the coater was brought to a temperature of about 400° C., and the temperature was maintained at about 400° C. throughout the coating reaction. After fluidization was established, a mixture of the reactant gases, $WF_6$ and $H_2$, was introduced into reactor 50 through gas inlet 27, hydrogen continuing to be introduced at a rate of about 500 $cm^3$/min. and tungsten hexafluoride being introduced at a flow rate of about 20 $cm^3$/min. Both gases were simultaneously and continuously introduced into the reactor for a total coating period of about 30 minutes. Valves located upstream from gas inlet 27 allowed adjustment of the flow rate of hydrogen gas and allowed substantial mixing of the reactants to occur within conduit 26 upstream from gas inlet 27. Conduit 26 and gas inlet 27 were water-cooled to a temperature of about 45° F. so as to prevent the reactant gases from reacting prior to their entry into the coating chamber.

As the coating reaction proceeded, tungsten metal was deposited onto the woven graphite material, as well as onto the carrier particles. The flow rate of hydrogen was gradually increased so as to maintain the fluidization of the bed. The ratio of the flow rate of $H_2$ to $WF_6$ at the beginning of the coating reaction was about 25:1 and at the end of the coating reaction was about 50:1. The average density of the fluidized bed after coating was between 0.9 and 1.0 g/$cm^3$, and the volume of the carrier material after coating was about 10.25 $cm^3$.

The tungsten-coated woven graphite discs which were coated under the above-described conditions were coated with about 75 wt % tungsten, had thicknesses after coating of 0.0138 inch, and had an average strand thickness after coating of about 330 μm. The mass of a disc which had weighed 0.0584 g before coating was 0.2322 g after coating. In FIGS. 5, 8, 10, and 11, the uniformity of the metal coating which was formed under the particular conditions described above can very clearly be seen. One can easily see (particularly in FIG. 8) that the porosity of the coated cloth was retained. One should note also, as shown especially in FIG. 8, that virtually all of the filaments making up the woven strands including even the inner filaments are substantially uniformly coated. This is quite different from the coated discs shown in FIG. 7 which were coated by the prior art method. This improvement in coating occurred, despite the fact that the flow rate of $H_2$:metal-containing gas was generally *higher* in Example 2 than in Example 1. Furthermore, although it is not shown in the drawing, all of the 5 discs which were coated in the fluidized bed appeared to have a virtually identical coating.

The uniformity of the coating obtained with use of the inventive method clearly will function to maximize the strength of a coated product which is formed from a given amount of plating material and clearly results in a very large surface area of plated material obtainable from a given amount of metal for plating, aside from the amount deposited on the carrier material (which can be recycled). Because of the uniformity of the coating, the porosity of the original woven material will be retained until the thickness of the coating reaches a level sufficient to close the pores. Such characteristics of the coated product can be used to provide excellent high temperature metal filters when refractory metals are plated. Because of the very large surface areas which the coated woven materials have, another application is to use the coated woven material as a catalytic support.

Comparing the results of Examples 1 and 2, one can reasonably expect that whenever one coats a woven material by using a particular CVD reaction at a particular reaction temperature and pressure and at a particular ratio of reactant gases, the uniformity of the coating of woven material will be improved (as compared with the coating obtained on a stationary woven substrate) by causing the CVD reaction to take place at or near the surfaces of the woven material while the woven material is moving substantially randomly within a fluidized bed.

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

We claim:

1. A method of coating a woven material with a coating material, said method comprising the following steps in the following order:

(a) introducing a first gas into a chamber containing a bed of carrier particles, said first gas being introduced at a rate sufficient to produce and maintain during the following steps a fluidized bed;

(b) introducing pieces of said woven material into said fluidized bed, said pieces being sufficiently small relative to the size of said chamber and having a density relative to the density of said fluidized bed so that said pieces move substantially randomly in said fluidized bed;

(c) heating said chamber and allowing the average temperature of said fluidized bed and of said woven material to reach a chosen deposition temperature, said chosen deposition temperature being a temperature which is at least as high as the temperature required for said coating material to be formed in a particular chemical vapor deposition reaction from at least one reactant gas, and said chosen deposition temperature being a temperature low enough so that said woven material retains its porosity;

(d) introducing said at least one reactant gas into said fluidized bed, said at least one reactant gas being such that it reacts to deposit said coating material onto said woven material at said chosen deposition temperature; and (e) allowing said at least one reactant gas to react within said fluidized bed to deposit said coating material onto said woven material, said woven material having a melting point which is higher than said chosen deposition temperature.

2. A method according to claim 1, wherein said at least one reactant gas comprises a gas selected from the group consisting of:

(a) at least one compound selected from the group consisting of metal halides, (b) at least one compound selected from the group consisting of nickel carbonyl, molybdenum carbonyl, and iron carbonyl, and (c) at least one hydrocarbon which forms pyrolytic carbon.

3. A method according to claim 2, wherein said first gas is selected from the group consisting of hydrogen and a mixture of hydrogen and at least one inert gas and wherein said at least one reactant gas comprises at least one metal hexafluoride selected from the group consisting of tungsten hexafluoride, rhenium hexafluoride, molybdenum hexafluoride, and mixtures thereof.

4. A method according to claim 3, wherein said first gas comprises hydrogen, wherein said at least one reactant gas comprises tungsten hexafluoride and wherein said chosen deposition temperature is within the range from about 150° C. to about 1000° C.

5. A method according to claim 4, wherein said chosen deposition temperature is within the range from about 150° C. to about 600° C.

6. A method according to claim 5, wherein the ratio of flow rate of said hydrogen: said tungsten hexafluoride is within the range from about 10:1 to about 50:1.

7. A method according to claim 6, wherein said woven material is selected from the group of materials consisting of graphite cloth, ceramic cloth, and metal cloth.

8. A method of producing a flexible, tungsten-coated cloth, said method comprising the method according to claim 6 or claim 7, wherein said hydrogen and said tungsten hexafluoride react to deposit tungsten onto said woven material in an amount less than about 95 weight percent tungsten.

9. A method according to claim 7, wherein said woven material is graphite cloth and wherein said ratio of flow rates of hydrogen:tungsten hexafluoride is within the range from about 15:1 to about 20:1.

10. A method according to claim 9, wherein said chosen deposition temperature is within the range from about 400° to about 425° C.

11. An article of manufacture prepared according to the method of claim 1 or of claim 10.

12. A multiplicity of substantially identical substantially uniformly coated woven articles prepared according to the method of claim 1 or claim 10.

13. A method of producing a catalytic support, said method comprising:

coating a woven material with a metal according to the method of claim 1, and recycling the metal which was deposited onto said fluidized bed, thereby producing a very large metallic suface area from a relatively small amount of said metal.

14. A method of improving the uniformity of a coating material deposited onto a woven material by a chemical vapor deposition reaction, the improvement comprising: coating each individual filament making up the strands which are woven to form said woven material by allowing the chemical vapor deposition reaction to proceed at or near the surfaces of said woven material while said woven material is in substantially random motion within a fluidized bed.

15. A method according to claim 14 wherein said woven material is graphite and wherein said chemical vapor deposition reaction comprises a reaction of hydrogen gas and tungsten hexafluoride gas at a temperature within the range from about 150° to about 600° C., at a pressure within the range from about 10 to about 150 torr, and at a ratio of flow rates of hydrogen:tungsten hexafluoride which lies within the range from about 10:1 to about 50:1.

16. An article comprising:

a woven material coated with a coating material, said woven material comprising woven strands wherein each of said strands is formed from a plurality of smaller filaments, wherein said filaments are individually and substantially uniformly coated throughout said woven material, and wherein said woven material is substantially uniformly coated on all surface areas and is porous after being coated.

17. An article according to claim 16 wherein said woven material after being coated is free from imperfections due to stationary supporting means.

18. An article according to claim 17 wherein said coating material is selected from the group consisting of (a) metals, (b) metal carbides, and (c) pyrolytic carbon.

19. An article according to claim 18 wherein said coating material is selected from the group consisting of tungsten, rhenium, molybdenum, and mixtures thereof and wherein said woven material is selected from the group consisting of graphite cloth, ceramic cloth, and metal cloth.

20. An article according to claim 19 wherein said coating material is tungsten and wherein said woven material is graphite cloth.

21. An article according to claim 20 wherein said tungsten which coats said graphite cloth comprises less than about 95 percent of the total weight of said coated graphite cloth.

22. A multiplicity of substantially identical substantially uniformly coated woven articles as recited in claim 16 or claim 20.

* * * * *